United States Patent [19]

Hall et al.

[11] 4,001,902

[45] Jan. 11, 1977

[54] SUSPENDED BED AND SHELTER

[76] Inventors: John O. Hall; Anna Cobb Hall, both of 1419 N. Negley, Pittsburgh, Pa. 15206

[22] Filed: Jan. 16, 1975

[21] Appl. No.: 541,598

[52] U.S. Cl. ..... 5/121

[51] Int. Cl.[2] ..... A45F 3/22

[58] Field of Search ..... 5/121–125, 5/127, 128, 343, 344; 135/1.2

[56] References Cited

UNITED STATES PATENTS

| | | | |
|---|---|---|---|
| 622,411 | 4/1899 | Black | 5/122 |
| 700,978 | 5/1902 | Dalmer | 5/122 |
| 1,401,846 | 12/1921 | Wiles | 5/121 |
| 2,375,792 | 5/1945 | Kearny | 5/121 |
| 2,629,111 | 2/1953 | Komey | 5/351 |
| 3,675,256 | 7/1972 | Tallarico | 5/120 |

FOREIGN PATENTS OR APPLICATIONS

| | | | |
|---|---|---|---|
| 702,851 | 2/1941 | Germany | 5/122 |

*Primary Examiner*—Casmir A. Nunberg
*Attorney, Agent, or Firm*—Staas & Halsey

[57] ABSTRACT

A bed comprising a hammock and insulated sleeping bag wherein the insulation of the bottom of the bag is placed underneath the hammock to avoid compression by the sleeper and the remainder of the bag is attached to the upper surface of the hammock to cover the occupant, with the hammock portion located between permanently attached edges of the bag serving as a block baffle to the insulation; and a tent combined with said bed to form a shelter by removably attaching the lower edges of the tent to the edges of the hammock, providing an apron to carry off water to below the line of attachment, and suspending the tent over the hammock and bag from the same two supports sustaining the hammock and using cords between the upper surface of the bag and the tent ridge to raise the upper portion of the bag for cooling when desired; and a similar bed for two sleepers equipped with movable cords or tapes running between the spreader bars to divide the hammock into separate sleeping places while allowing for varying weight and girth of the occupants, with a spreader bar of such height in the center compared to the ends as to provide for matching the slopes of the sides of the hammock for each sleeping space, to which double bed the tent may be combined in the same fashion as for a single bed; and a hammock comprised of cloth of varying width, like an hourglass in appearance when flat, so that the longitudinal center line thereof may be kept straight and level while at the same time achieving a degree of sag of the edges of the hammock necessary to stability, the amount of such sag while keeping the center line straight being the result of variation in the width of the cloth between the waist and ends of the hammock along the curve therein.

16 Claims, 9 Drawing Figures

SUSPENDED BED AND SHELTER

BACKGROUND OF THE INVENTION

The general purpose of this invention is to provide a lightweight, portable, warm, comfortable, weather-tight, and insect-free bed and shelter for hikers and campers by means of combining a hammock, sleeping bag, and tent and incorporating new features of construction therein. The specific advantages of this invention are (a) improved warmth of that part of the sleeping bag under its occupant, while conserving other normal thermal qualities; (b) better protection of the occupant against wind, rain, snow, dew, ground dampness, insects, rodents, and other small animals; (c) a more level and normal sleeping position for the occupant; (d) improved stabilization aimed at preventing overturning; (e) means for separating the tent portion of the combination when its use is not required; (f) means connecting to the device for storing personal possessions and camping supplies above ground for the convenience of the occupant and for protection against dampness, insects, and animals; (g) the full range of these advantages at less overall weight of equipment than normally found under the current methods; and (h) the full range of these advantages in a larger size to accommodate two persons.

Hikers, campers and others faced with living out of doors and with the need to provide lightweight equipment for sleeping and shelter have for years wrestled with the problem of how to obtain maximum warmth as well as protection for themselves and their beds from rain, dew, ground water, cold, insects, and small animals. This is especially true for persons who hike long distances while carrying everything necesssary for comfort and survival. Veteran campers have repeatedly said that camping is never comfortable unless one has a dry, warm, and restful bed. Achievement of these basic objectives has always been less than satisfactory. For years campers have carried blankets or comforters such as those used at home, in which they rolled themselves for sleep as best they could. When sleeping on the ground a common method in the early days of this country was to construct a bed of balsam branches, leaves, or other vegetation which would tend to conform to the human body while at the same time providing some insulation from the ground's dampness and coldness. This method was never sufficient to the need and in present times such materials, even when available, are quickly exhausted if used by large numbers of campers. But now, as then, it is not uncommon for a camper to excavate the ground slightly to make the surface thereof conform somewhat to body contours.

The sleeping bag

While the above practices may yet be followed when possible and desirable, four major developments have taken place over the years to assist the camper in obtaining a better bed in the wilderness. The first was the advent of the sleeping bag, which, by utilizing zippers and other fasteners, helps to prevent the excessive escape of body heat from around the sleeper and at the same time to minimize the entry of cooler air from outside. The sleeping bag, however, does not provide comfort in terms of avoiding hardness, uneven surfaces, cold, insects and rodents. For example, the weight of the human body so compresses the material under the sleeper that much of its insulating potential is lost with resultant loss of body heat to the ground.

The air mattress and foam pad

The second development was the introduction of the air mattress and foam pad for use under the sleeping bag. The air mattress has provided some of the comfort of a mattress as commonly used on a bed, and, to a lesser extent, the qualities of an insulator against cold. As experts in this field have pointed out, air mattresses are not fully reliable and sometimes lose pressure during the night. Furthermore, their insulating qualities are limited due to heat transfer by convection within the air mattress itself, again resulting in the loss of body heat. Because of these disadvantages, as well as weight and bulk, most hikers will not carry an air mattress. Foam pads of sufficient thickness provide a measure of reliable softness and insulation but are bulky and heavy.

Insulating materials for sleeping bags

The third major development was the utilization of new synthetic materials for insulating sleeping bags. Some of these provide good insulating qualities, although weight is still a factor. Goose down, long used in bedding, continues to be preferred because of its lightness an superior insulating properties, especially for backpackers. But regardless of the kind of insulating material employed, it all compresses tightly under the weight of the sleeper with consequent severe loss of thermal protection.

Tents for protection from inclement weather

In addition to the problems just described, the outdoorsman encounters wind, rain, and snow, from which his bed must be protected if it is to serve its intended purpose. Tents universally supply this need and over the centuries have been constructed first of skins, then of vegetable fibers. Now they are usually constructed of lightweight synthetic fibers, which constitute the fourth major development. For backpackers, where weight is an important factor, very small tents are used. The hard ground below the tent floor remains the surface on which a sleeping bag must be extented, at least for backpackers, and leakage of ground water into the tent is commonly experienced from prolonged rain or melted snow. Moreover, repacking such a tent after resting on muddy ground always constitutes an inconvenience. The anchoring of tents has continued to be a problem, and upset and ripping of tents by heavy wind continues to plague campers and risk their comfort and well-being.

Use of ground sheets in lieu of tents

When a tent is not carried the camper is usually required to provide an impermeable ground sheet to protect his bed against ground water. Sometimes it is wrapped around the sleeper to give temporary and usually insufficient protection from rain and cold. Sometimes a trapaulin is laid or stretched beneath the sleeper, with the same limited usefulness. Although now usually made of new, lightweight materials, this equipment nevertheless adds to the weight to be carried. Also, sleeping on the ground leaves a person vulnerable to crawling insects and rodents, which is only partially eliminated even when floored tents are used.

Summary of present conditions

The conditions thus described represent the current state of the art of shelters and beds for outdoorsmen, especially backpackers. In terms of warmth, comfort, weight, and protection from rain, snow, insects, and animals, existing equipment has significant defects. These shortcomings not only constitute important limiting factors to the comfort and enjoyment of hikers and campers in wilderness areas, but are sometimes critical to their very survival. Sometimes deliberate risks are taken because of weight limitations and certain important items of equipment are left behind. Unanticipated bad weather, for example, may spoil an excursion when adequate rain shelter has not been included. Clearly, lighter and more efficient equipment would reduce these problems and enhance the pleasure and safety of backpacking and camping.

The use of hammocks

Although the sleeping problems of the camper/hiker have been studied over the years, relatively little attention has been given to the hammock as a potential solution for many situations despite the long and satisfactory use of that type of bed in certain regions and under specific conditions. For example, hammocks have been used aboard ships for many centuries. In some tropical regions of the world today, such as Yucatan, Mexico, it is the preferred method of sleeping for the majority of the population. Double hammocks, accommodating two persons, are also common there. The U.S. Army developed a hammock for use in tropical areas, together with mosquito net and cover against rain. The advantages of hammocks over sleeping on the ground or floor have been recognized in a number of instances.

Hammocks in the temperature zones. Nevertheless, in the temperature and colder zones, hammocks have not seriously completed with sleeping bag/air mattress and sleeping bag/foam pad combinations. A major drawback has been the lack of warmth in existing hammock construction. Also militating against widespread use of hammocks in the United States has been their general discomfort for sleeping, wherein the body must generally remain in a curved position, resting mostly on the back, and discomfort becomes readily apparent after relatively short periods of time. This problem stems from the way in which most hammocks are constructed, which construction differs markedly from the design of net sleeping hammocks used in the tropics.

SUMMARY OF THE INVENTION

It is apparent that up to the present time there remain significant defects in equipment offered as bed and shelter to campers and hikers. The present invention constitutes an important improvement on such equipment by designing a hammock permitting a longitudinally flat or near-flat body position, effectively combining a sleeping bag and said hammock, and the combination hammock/sleeping bag with a tent, to provide especially lightweight, warm, comfortable, and sheltered beds. Three embodiments of the combination hammock/sleeping bag/tent invention are presented herewith. The first two embodiments are for single occupants and the third embodiment for two persons.

Figure 1:
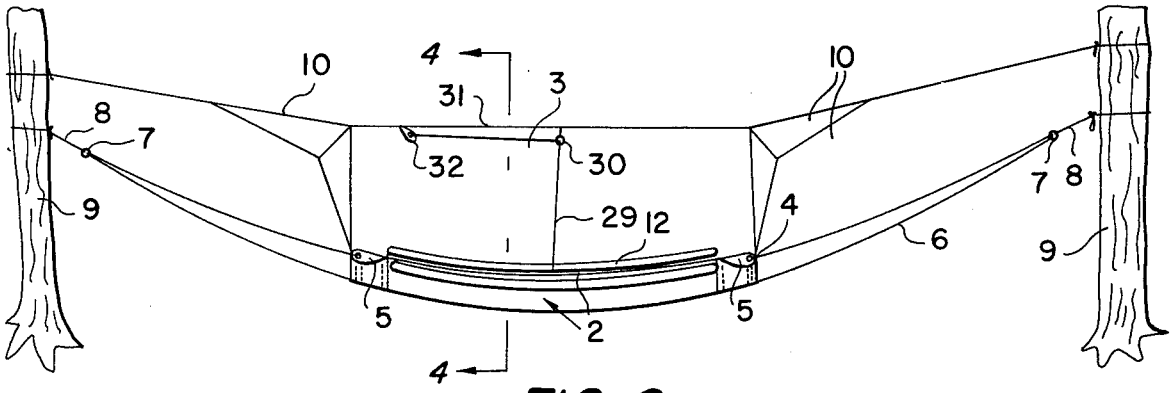
FIG. 1 is a side elevational view of a first embodiment of the suspended bed and shelter.
Figure 2:
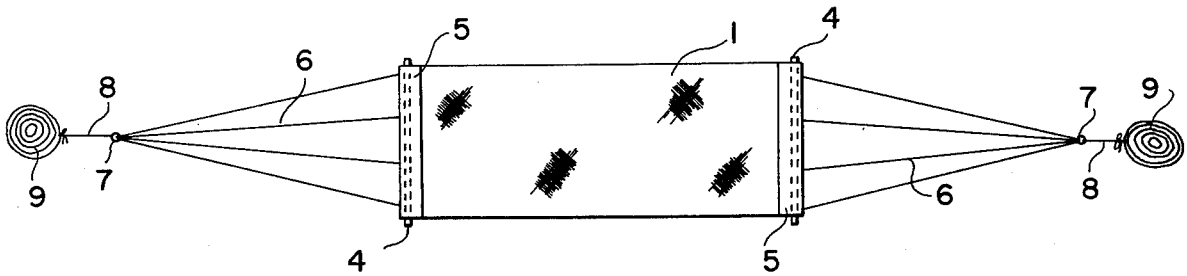
FIG. 2 is a top plan view of the suspended hammock of the bed and shelter embodiment of FIG. 1.

DESCRIPTION OF THE PREFERRED EMBODIMENTS:

In FIGS. 1–2 there is shown a combination hammock, sleeping bag, and tent consisting of a hammock 1 with sections of a sleeping bag 2 attached to both faces thereof, the whole being covered with an attached tent 3. The hammock is equipped with a spreader bar 4 in a pocket 5 at each end of the hammock 1 to which is attached a stringing assembly 6 which is then gathered at a point 7 from which a rope 8 leads to a tree 9 or other such support to which it is tied for suspending ground the combination hammock, sleeping bag, and tent. The tent 3 is held upright over the hammock 1 and sleeping bag 2 by ropes 10 extended from the ridge line 31 of the tent 3 to the same trees 9. A cord 29 is attached to the top section 12 of the sleeping bag, from which it runs vertically to a ring 30 attached to underside of the ridge line 31 of the tent 3, and thence along ridge line 31 to a point above the head of the occupant where it may be attached to a loop 32 or similar fastener after selectively elevating the top section 12 above the occupant for any desired distance up to the limit of the bag's dimensions for providing space in the interior of the hammock for cooling and ventilating purposes.

FIG. 2 provides a view from above the hammock only, showing a rectangularly shaped hammock 1 with spreader bars 4 in pockets 5, stringing assemblies 6, gathering rings 7 for the stringing assemblies, and ropes 8 to trees 9.

Figure 3:
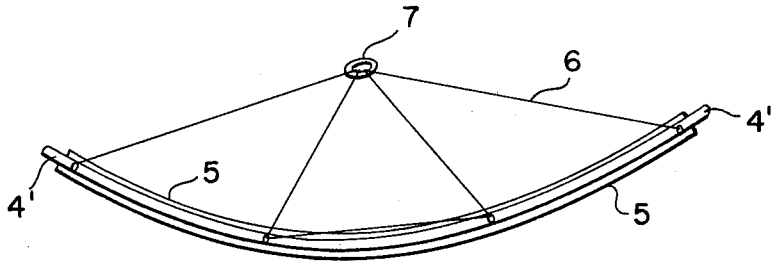
FIG. 3 is a top plan view of an alternative curved spreader bar construction which may be employed with the bed and shelter embodiment of FIG. 1.

In the embodiment of FIG. 3 the spreader bar 4' is illustrated as curved (although it may be straight if preferred), and placed in pocket 5 with stringing assembly 6 attached thereto and then gathered at ring 7.

Figure 4:
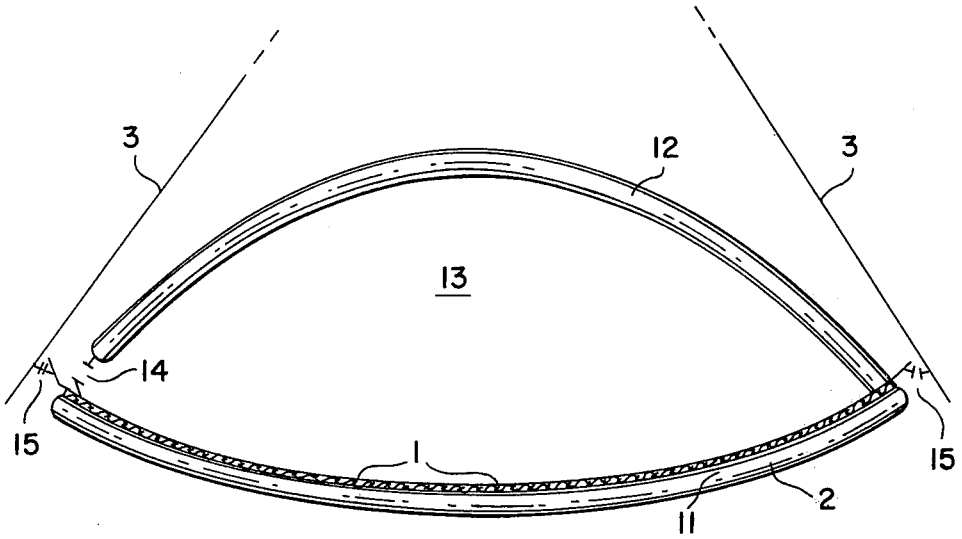
FIG. 4 is a cross-sectional view taken along line 4—4 of FIG. 1 illustrating in particular the insulated bottom section of the sleeping bag as located beneath the body supporting material of the hammock.

FIG. 4 is a cross section along line 4—4 of FIG. 1, showing the hammock 1, the insulated bottom section 11 of the sleeping bag which is sewn or otherwise made to adhere snugly to the lower face of the hammock 1 (alterntively a part of the hammock may be made an integral part of the bottom section, of the sleeping bag or vice versa), the top section 12 of the sleeping bag which covers the sleeper when occupying space 13, the zipper 14 representing a means of closure of the sleeping bag sections 11 and 12 along the side which affords entry to the occupant and also for closure of one end of the bag as well, and tent 3 attached by zipper 15 to the edges of the hammock 1 on both sides as well as the ends.

It is apparent from FIG. 4 that the insulated bottom section 11 of the bag 2 is beneath the body-supporting material of the hammock 1. The bottom face of the hammock may be used as one side of the section of the sleeping bag 2 underneath the hammock 1, thereby economizing on weight and material, or alternatively, a separately constructed, self-contained section of the sleeping bag may be attached to the bottom face of the hammock. Constructed either way, the weight of the sleeper does not significantly compress, if at all, the insulated bottom section, thereby permitting it to retain its intended insulating quality. The present invention, by retaining the loft (thickness) of the sleeping bag under the occupant, offers a distinct advantage over the thermal quality of a sleeping bag used on the ground or other such surface where the weight of the sleeper, and to a lesser degree the weight of the upper shell of the sleeping bag, so compress the portion underneath as to nullify substantially its insulating capacity.

Beneficial results of placing the insulation 11 under the hammock 1 include: (a) providing uniform warmth: (b) reducing the amount of insulation needed, with consequent savings of weight and bulk; (c) enabling a more ready escape of body moisture from beneath the sleeper; (d) lowering the temperature range in which the sleeping bag is effective; (e) reducing internal convection caused by the pumping or "bellowing" action of sleeper movement; (f) enabling a more accurate calculation of the amount of needed insulation for a given temperature by reducing the number of variables; (g) protecting against mud, ground water, crawling insects and rodents. The hammock 1 also serves as a block baffle in the sleeping bag 2 along any side where both sections 11 and 12 of the bag are fixedly attached, thereby eliminating the weight and cost of such baffle in down and other bags in which a shift of insulation is a problem.

Another major feature of the embodiment of the invention illustrated in FIG. 1–4 is the "combination" of a tent with the hammock and sleeping bag as described above, resulting in distinct advantages not a part of these devices when in separate use, or in any combination previously conceived and designed. The insulation provided in the bag 2 and hammock 1, by constituting the floor and bottom of the tent 3, increases the heat retention within the tent which, in turn, increases the capacity of the sleeping bag, thus enabling a reduction in insulation in the sleeping bag, or a lowering of the temperature for which it is effective. At the same time, by utilizing the lifting cord 29 attached to the upper surface of the sleeping bag 2 to raise the bag above the sleeper for greater convection, the upper temperature range of the bag is increased without changing the lower limit, a matter of importance because of the disadvantage often mentioned of the narrow range in existing bags.

The elevation, of the tent 3 above ground level, positions same above the mud, ground water, crawling insects and rodents. Anchorage of the tent 3 to the hammock 1, and to the same two supports 9 as the hammock, provides a high degree of strength and flexibility for withstanding gale-force winds, including potentially damaging gusts of high intensity. The tent 3 does not have to rely upon stakes of dubious security, depending as they do upon the nature of the soil, and the possibility that rain may loosen them. As a further advantage, when "breathable" material is used in the hammock and sleeping bag the tent is better ventilated against condensation of body moisture on its walls, an advantage not possible in ground-placed tents with impermeable floors.

The hammock 1, as illustrated in FIG. 2, consists of a cloth in generally rectangular shape with a pocket, loop, or similar device 5 at each end to accommodate the spreader bar 4 of rigid material, such as wood or light metal, which bar maintains the cloth in extended position latitudinally for accommodation of the occupant. The cloth requires qualities of high tensile strength, especially in the warp, and rip resistance, while being lightweight. Attached at two or more points to each spreader bar 4 is the stringing assembly 6 of approximately 4' to 5' in length which leads to a single point 7, such as a metal ring, which in turn is attached by the rope 8 to a tree 9 or other support in order to hang the hammock. The cords of the stringing assembly 6 should stretch as little as possible, so that the hammock will not greatly increase its sag under the weight of the occupant, and especially not to do so in a progressive manner during a night's sleep. Probably the best cord material is synthetic, made in a fashion to resist stretch. The length and width of the hammock 1 is sufficient to accommodate a sleeping person comfortably, which for most adults may vary from about 27" to 32 in width and 76" to 86" in length.

In hanging a hammock two important characteristics are sought for the benefit of the occupant: stability and level body position. These two factors are in conflict. The greater the longitudinal sag in the hammock, the greater is the stability, but at a corresponding sacrifice of level body position. On the other hand, when the hammock is hung more tautly in order to achieve a more level body position, a degree of stability is lost, subjecting the occupant to a greater risk of being upset. Whenever the weight of the body is equally divided on both sides of an imaginary line drawn longitudinally down the center of a hammock having two supporting points or ropes, there is a maximum stability for a given amount of sag. However, when the weight is shifted more to one hammock begins to tilt, with the side receiving the greater weight becoming lower. The greater the movement of weight to that side, the greater is the tilt experienced until finally the occupant falls from the hammock. However, the greater the longitudinal sag, the greater is the distance from the center to which weight can be shifted without the occupant being upset. Obviously, a compromise is needed to enable the occupant to have reasonable security from being upset while at the same time to achieve a comfortably level body position. In the present invention two features other than the amount of sag, exist to compensate for the tilting tendency, namely, the long stringing assemblies 6 and the curved spreader bars 4'. The longer the stringing assembly. the greater is the allowable amount of lateral weight shift without reaching the point of overturning the hammock. However, practical considerations of distance between trees or other supports, as well as amounts of cordage, tend to restrict the length of stringing, assemblies. Furthermore, each additional measure of such length, for a given width of the hammock, adds less stability than the previous unit. These factors suggest that the practical maximum length of a hammock's stringing assembly may be about 5' or about 70% of the occupancy portion of the hammock. Double hammocks, therefore, can benefit from proportionately longer lengths than single ones.

The other method of achieving stability is through use of the curved spreader bars 4', illustrated in FIG. 3.

The curved spreader bars 4' introduce a latitudinal curve in the hammock 1. The resulting higher sides maintain the occupant in a satisfactorily supported position for longer distances from the hammock's longitudinal center than would otherwise be possible. Diagonal placement of the body is still practical and desirable for changes of sleeping position and achievement of flat position. When a person lies in either the diagonal position or with weight off center, the upward roll of the side next to the shoulder gives better support and a corresponding feeling of security. Furthermore, the latitudinal curve enables the body to retain its normal position on the head-to-toe axis, whereas with straight spreader bars a slight twist of the body may be detectable when resting in a diagonal position. Additionally, the cradling effect produced by the curved spreader bars helps prevent what otherwise might be a tendency for an arm, when relaxed, to fall off the lower side of the hammock.

In addition to the factors involved in the construction of the hammock 1 itself, additional stability is derived from the supportive action of the tent 3 in the combination. Whenever the hammock 1 is lowered on one side by a shift in weight, the ridge line 31 of the tent 3, tied between the same two uprights 9 as the hammock 1, is also pulled down resisting such tendency and supporting the sinking edge. An additional aid in achieving a level body position is the employment of a catenary-like cut in the hammock's longitudinal edges, an arrangement which raises the hips slightly relative to the head and feet. Also, by positioning one's body in a diagonal position in the hammock so that opposite corners are lowered under the head and feet, a further degree of flatness is achieved without excessive risk of the occupant being upset and offers opportunities for restful changes in body position. At the same time, the hammock 1 tends to conform to the shape of the human body and thus provides a comfort superior to the unyielding ground or to the hard boards of a crude shelter-bed as sometimes are built along commonly used hiking trails.

The sleeping bag 2, as illustrated in FIG. 4, is constructed in two sections, 11 and 12, with the smaller insulated section 11 sewn or otherwise attached closely to the bottom surface of the hammock 1. No large air pockets are left between the two surfaces in order to conserve the thermal qualities of the insulated bottom section 11 and to obtain the full benefit of the bag's loft. Alternatively, the cloth portion of the hammock 1 may be made an integral part of the lower portion of the sleeping bag 2 by using it as one face thereof. Cloth of lightweight synthetic material is preferable in order to help achieve the lowest practical weight for the equipment.

The top section 12 of the sleeping bag 2 is used above the hammock 1. For this purpose it may be sewn to the hammock 1 along one longitudinal side in a manner providing adequate loft at the line of attachment. A zipper 14 or other fastening means may then be used along the bottom edge of the hammock 1 and up the other side to close the sleeping bag 2. Alternatively, it may be removably attached at all points. The upper edge is left open for the occupant's head, which may be equipped with a hood. The width of the top section 12 of the sleeping bag 2 is approximately 50% greater than the insulated bottom section 11 in order to provide adequate interior space for a sleeper. However, these proportions may be altered if the hammock shape is changed. For example, if the hammock 1 is made more concave the bottom width of the bag may be increased and the top section's width reduced.

In constructing the hammock 1 and sleeping bag 2 portion of the bed and shelter, the edge of the hammock 1 on both sides and both ends is left free in sufficient amount for attaching a zipper 14 or other means for connecting the tent 3 thereto. However, if the tent 3 is not to be added to the combination, the sleeping bag 2 need not be divided in two parts, but after the correct portion is attached to the bottom surface it may then be permitted to wrap around one of the long sides. A zipper 14 may then be used, as already mentioned, to close one end and the other side.

Ordinarily, sleeping bags are not constructed with waterproof cloth on the underside, next to the ground, despite certain potential advantages such as greater warmth and protection against ground water, because it prevents the escape of body moisture from that side of the bag. Such natural release of body moisture has generally dictated the use of breathable cloth instead. Only in a few lighter and cheaper sleeping bags, where the differential in outside and inside temperatures is not expected to be great, have watertight bottoms been used. However, in this case the loft of the insulation under the sleeper is as great as above, giving more opportunity for body moisture entering the bag beneath the sleeper to escape around the sides through an insulation that has retained its full porosity. Therefore, an impermeable bottom, full or partial, is a feasible alternative when the combined hammock 1 and sleeping bag 2 are used in moderate weather without great humidity. When thus employed the warmth of the whole arrangement is increased because of the consequent reduction of convection within the bag. At the same time, an impermeable bottom permits easy cleaning of that part of the sleeping bag which is most vulnerable to soiling during the process of setting up or taking down.

The tent 3 is designed so that the bottom edges of the four walls of the tent, which normally touch the ground in other types of tents, are fastened by zipper 15 or otherwise to the edges of the four sides of the combined hammock 1 and sleeping bag 2. Allowance is made in the tent for sag in the hammock 1. A small apron covers the zipper 15 and extends downward a sufficient distance to prevent rain from flowing into the hammock 1 and sleeping bag 2 or even wetting the bottom thereof. The ridge of the tent 3 is supported by cords 10 from the same supports used for the hammock 1.

Figure 5:
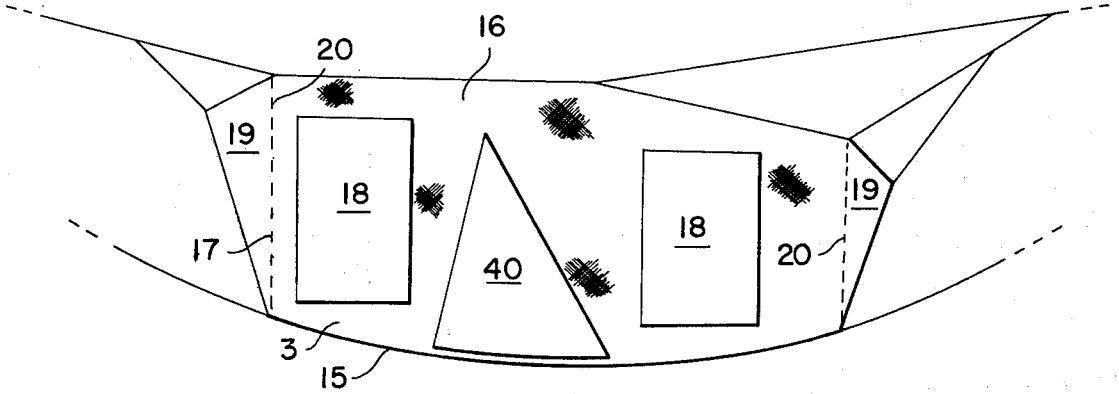
FIG. 5 is a side elevational view of the first embodiment of the suspended bed and shelter illustrating in particular the door and window construction thereof.

As illustrated in FIG. 5, one of the sidewalls 16 is provided with a zipper 17 along the line of its attachment with an endwall 20, which when used in conjunction with the zipper 15 attaching the tent 3 to the hammock 1 and the zipper 14 for closing the sleeping bag 2 permits entry of a person into said tent 3 and sleeping bag 2. Alternatively, for entering the tent 3, a closable door 40 may be placed in the sidewall 16. Closable windows 18 are also provided with mosquito net to serve against insects when open. It is apparent that all of the four walls may be provided with windows, if desired. The reference numeral 19 designate portions of the sidewall 16 that may extend beyond the end walls 20 for deflecting wind and rain. The two sidewalls 16 of the tent 3 extend beyond the end walls 20 thereof so that the end walls 20 will not receive the full force of rain and in order to allow the windows 18 in the ends 20 to be open for ventilation while raining if desired.

Such protection of the end walls 20 also makes it possible for them to be made of permeable or "breathable" cloth regardless of the kind of material used for the sidewalls 16, thus allowing the escape of body moisture. The sides as well as the ends of the tent 3 may be equipped with closable openings which may also be covered with a mosquito bar. The tent 3 is entered from one such opening in a side. If the tent's sidewalls 16 are constructed of material permeable in a hard rain, then an impermeable fly may be used above the tent 3, supported from the same two uprights and held in extended position by ropes to the ground. However, construction of the sidewalls 16 with impermeable cloth will make the fly unnecessary, although at times occasioning a greater condensation of moisture from respiration and perspiration on the interior tent faces than would be the case with permeable material.

The tent 3 may be dried very easily whenever any moisture collects on the interior surfaces resulting from human occupancy. Simply by unfastening the tent 3 from the hammock 1 and reversing the surfaces, exposure to wind and sun will ordinarily dry the surfaces quickly. The tent 3 may remain conveniently suspended from the uprights during this process. No such degree of convenience is possible with existing tents because of the built-in floors. Also, being suspended, the tent 3 is free of ground water and mud, as well as crawling insects and rodents. Neither a waterproof floor, nor a ground sheet is needed, thereby reducing weight below equipment combinations requiring such items.

Due to the sag in the hammock 1, a condition not present in other tents, the ridge height of the tent may be very low and still provide space for sitting upright in the hammock 1. The tent 3 is narrow because the width of the base is only that of the hammock. The hammock 1 and sleeping bag 2 substitute for the usual tent floor. These factors combine to make a very small tent, permitting a high degree of material economy and weight reduction.

Pockets for holding eyeglasses, flashlight, pocket contents, etc., can be placed at the head of the hammock next to the spreader bar and on the interior side of the end wall. Shoes may be hung from the ridge line 31 near the head or foot of the hammock 1 or underneath the hammock 1 near the head. A backpack may be secured above the stringing assembly 6 at the head where its contents may be obtained by an occupant of the shelter by reaching through the window of the end wall 20. The pack may be covered with a poncho in event of rain, or the sidewalls 16 of the tent 3 may be extended at that end to form a canopy over the pack to keep it dry. In such ways the gear of a camper may be placed conveniently at hand. Even simple meal preparation may be undertaken on cold or rainy days within the tent 3 by heating water from a stove or canned fuel suspended from the ridge line 31 and then used to prepare freeze-dried foods and hot drinks.

Figure 6:
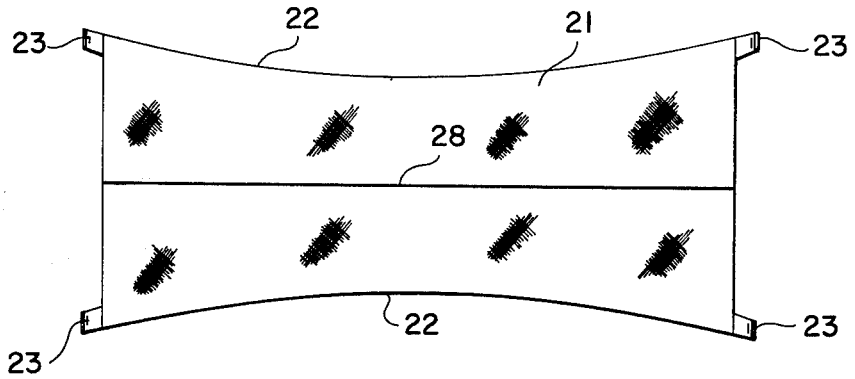
FIG. 6 is a top plan view of a second embodiment hammock portion of the suspended bed and shelter of the present invention.

A second embodiment of this invention is shown in FIG. 6. This embodiment differs from the first embodiment primarily in the design of the hammock portion. This hammock 21 is designed to enable an occupant to lie in a more nearly flat position than in other types. To accomplish this, the hammock 21 is connected to the spreader bars only at the four corners 23, and a pronounced hourglass shape of hammock cloth is employed.

Figure 7:
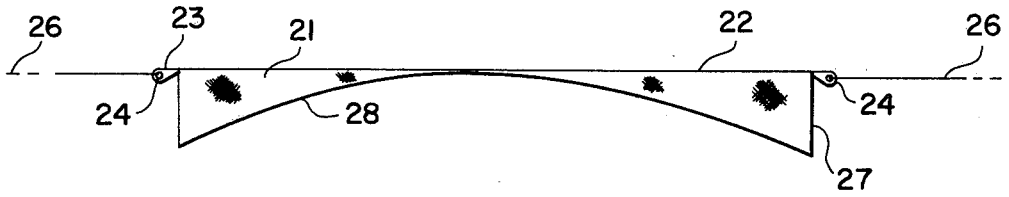
FIG. 7 is a side elevational view of the second embodiment hammock portion, illustrating in particular the effect of the hourglass shape of the hammock cloth when the hammock is tautly strung.
Figure 8:
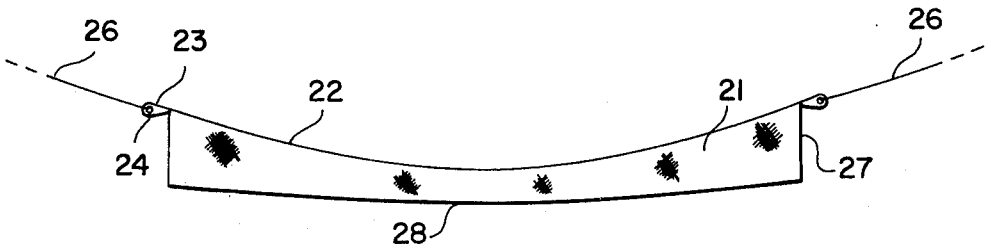
FIG. 8 is a side elevational view of a second embodiment hammock portion when corrected when occupied to a normal sleeping position.

The cloth of this hammock 21, when placed on a flat surface, has a modified hourglass appearance, the two longitudinal edges 22 being curved inward in a pronounced catenary-like cut, with the width at the waist or narrowest point generally, but not necessarily, less than the spreader bars 24. As depicted in FIG. 7, two corners 23 of each end of the hammock 21 are attached respectively to a spreader bar 24 of length less than the width of the end of the hammock 21, leaving the cloth between the two corners unattached so that said cloth may sag to a lower position. The wider the hammock cloth at head and foot relative to the distance between the two corners when attached to the spreader bar 24, the lower is the hammock 21 at these points when suspended. When the hammock 21 is pulled tightly (without an occupant), as shown in said FIG. 7, it assumes a profile in which the two longitudinal edges 22 are level, and also parallel except to the extent the distance between the corners 23 attached to a spreader bar 24 may be greater than the narrowest width of the hammock 21, while the center line 28 of the hammock 21 assumes a curve of almost the same catenary-like characteristics of the edges 22 as shown in FIG. 7, which is corrected when occupied to that of a normal sleeping position as shown in FIG. 8. The space 27 at each end of the hammock 21 may be filled in with waterproof or other cloth sewn to the hammock's ends and attached loosely to the spreader bars 24 so as not to assume any longitudinal pull.

FIG. 7 illustrates the effect of the hourglass shape of the hammock cloth on the center line 28 of a tautly strung hammock 21. Obviously, if a person could occupy the hammock 21 in this position without it sagging underneath his weight, his head and feet would be below his hips. This is an almost unthought of position in a hammock, and, of course, is undesirable. However, as shown in FIG. 8, when the hammock 21 sags from the weight of an occupant, which it will do as a matter of course and which is necessary to some degree in order to achieve ample security against upset, the center of the hammock comes down in relation to the ends to an extent that it is lower in the same amount as experienced in a good bed, thereby enabling the occupant to rest in a satisfactorily level position.

Thhis result is explained by two major factors. First, the catenary-like cut of the hammock 21 cloth draws the hammock's longitudinal edges 22 toward a parallel position as pull is exerted on the hammock 21 by the weight of the occupant, despite a contrary and partly effective sag in the woof, thereby raising the center slightly in proportion to the distance from the ends. Second, and more contributory to a level position, is the amount of increasing width of the hammock cloth as it approaches each spreader bar, resulting in even more latitudinal sag.

A spreader bar width of 32'' and a width of material at each end of 39'' and in the center of 27'' generally places the hips only about 2'' to 4'' below the head and feet when the hammock 21 is hung for good stability, which for most people is a comfortable sleeping position and similar to that in an ordinary bed. The measurements may be varied according to body size, weight, and preference as to sleeping position.

This hammock 21 is designed to be connected to the spreader bars 24 only at its four corners 23, leaving the remainder of the warp of the hammock 21 free of longitudinal pull from the stringing assemblies 26 in order that the degree of levelness of sleeping position possible in this design may be unimpaired. Although straight spreader bars 24 are shown in illustrative purposes, it is equally feasible to use curved or bent spreader bars. It is important that the two longitudinal edges 22 of the hammock 21 possess the tensile strength to carry the entire weight, and for this purpose the normal strength of the warp at said edges may be increased by sewing tape thereto or other such means.

The remaining features of this embodiment are not significantly different from those of the first embodiment. The shape of the two sections of the sleeping bag in the second embodiment may be adjusted slightly to fit the different cut of the hammock 21. The tent features are substantially unchanged.

Figure 9:
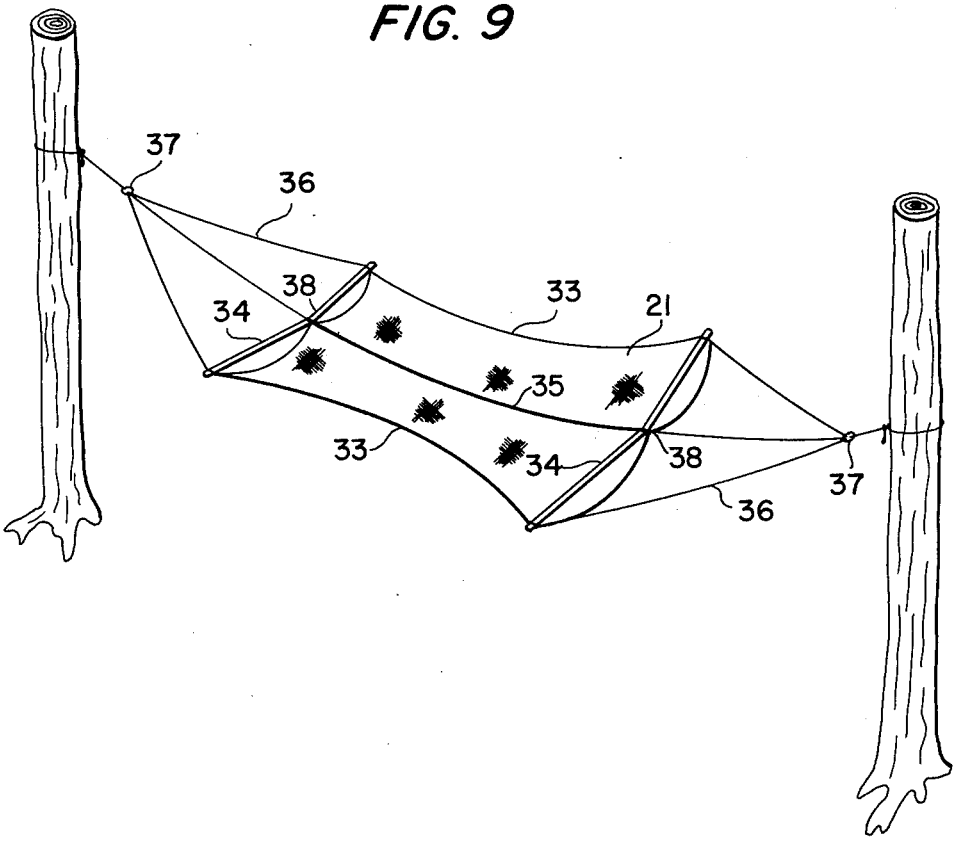
FIG. 9 is a perspective view of a third embodiment of the suspended bed and shelter adaptable to sleep two persons.

A third embodiment is shown in FIG. 9 whereby the same type of combined hammock and sleeping bag as described in the first embodiment may be enlarged to sleep two persons. In this case, however, a divider 35 is provided longitudinally in the hammock 21 to make each sleeping place distinct and to prevent the two occupants from rolling tightly against each other because of the natural latitudinal sag in the hammock. The divider 35 may consist of a cord or tape running between the spreader bars 34 underneath the hammock cloth and attached thereto or enclosed in a channel. The divider 35 may produce a ridge of perhaps 2'' to 10'' above the center line of each portion of the hammock 21, corresponding to the elevation of the cloth at a point on the opposite side of said center line equidistant therefrom along an imaginary line 90° to that of the center line. The lateral position of the divider 35 may be made adjustable to allow the correct proportion of space for each person if the hammock and sleeping bag are to be shared by persons of varying size and weight. This may be accomplished by placing several additional cords or tapes at varying distances from the longitudinal center of the hammock, permitting selection of that one which most nearly suits the weight and girth of the respective occupants. The distribution of weight for maintaining the two sides of the hammock 21 at equal elevations when occupied by persons varying in weight may be accomplished by shifting the gathering rings 37 toward that side of an extension of the center line of said hammock 21 occupied by the heavier person, in proportion to the difference in weights. Since the spreader bars 34 of this embodiment are longer than those of other embodiments, it may be desirable that they be jointed or hinged at 38 for ease in carrying.

The total width of the double hammock 21 is about 70% greater than the single model, with no change in length. Due to the increased width, however, the length of the stringing assemblies 36 is increased proportionately. The strengths of cordage, cloth, and spreader bars 34 are similarly increased. The sizes of the sleeping bag and tent are also increased in proportion.

The upper section of the sleeping bag of the double model is zipped on both sides to permit separate entry. It is not necessary for both persons to enter simultaneously in order to achieve balance, provided that the first to enter places most of his weight toward the longitudinal center until the second person enters. A similar procedure can be followed when one person leaves before the other.

Two important advantages of the double over the single arrangement are greater warmth in relation to equipment weight and reduced average carrying weight. The greater warmth comes from having two persons in relatively smaller space, thereby enhancing the effect of body heat. The additional weight of the equipment necessary to accommodate a second person is about 65% of that for one person (usually somewhat less than the percentage of additional width of the double hammock). This lower average weight offers, therefore, a particularly appealing arrangement for backpackers to whom weight is critical, and especially for married couples where the wife cannot be expected to carry the same amount as the husband. For example, the man might carry the double hammock and sleeping bag, which approximately corresponds in weight to the single model plus tent. The woman could carry the double tent, spreader bars, and stringing assemblies, a total of about 60% that of the man.

We claim:

1. A combination comprising a hammock, an insulated sleeping bag and a tent;

said hammock being a generally rectangular shaped sheet of material, providing a relatively level support surface for at least one occupant, with the longest edges thereof each defining a catenary curve, including a spreader bar attached to each of the shortest edges thereof and means for adjustably suspending said hammock attached to each said spreader bar;

said insulated sleeping bag formed of an upper insulated portion and a lower insulated portion, wherein said upper portion is attached to one of said longest edges of said hammock material and said lower portion is attached to substantially cover and insulate the underside of said hammock material; and said tent includes means for attaching said tent to said longest edges of said hammock material and means for supporting said tent above said hammock and said sleeping bag.

2. The combination as in claim 1, wherein said sleeping bag includes means for adjustably elevating said upper insulated portion above said hammock material.

3. The combination as in claim 1, wherein each said spreader bar is attached to two corresponding corners of said hammock material, formed by said longest and shortest edges.

4. The combination as in claim 1, wherein said hammock material includes a means for dividing said hammock into a plurality of elongated sections to provide relatively level support surfaces for a plurality of occupants.

5. The combination as in claim 4, wherein said dividing means being a reinforced line extending the length of said hammock material and connected to each spreader bar.

6. The combination as in claim 5, wherein said reinforced line extends along the longitudinal center of said hammock material.

7. The combination as in claim 3, wherein said hammock material includes a means for dividing said hammock into a plurality of elongated sections to provide relatively level support surfaces for a plurality of occupants.

8. The combination as in claim 7, wherein said dividing means being a reinforced line extending the length of said hammock material and connected to each said spreader bar.

9. The combination as in claim 8, wherein said reinforced line extends along the longitudinal center of said hammock material.

10. A hammock comprising:

a generally rectangular shaped material, with the longest edges thereof each defining a catenary curve;

said material including means for reinforcing along a longitudinal line between said longest edges;

rigid means for spreading said material and attached to the shortest edges thereof and also attached to said reinforcing means; and means for attaching said rigid means to an elevated object;

thereby defining a hammock suitable for use by two persons.

11. A hammock as in claim 10, wherein said reinforcing means is adjustable to any position between said longest edges.

12. A hammock as in claim 10, wherein said reinforcing means is along a center line between said longest edges.

13. A hammock for two people to lie side by side in discrete sections in level or near-level position from head to foot wherein the side edges of the hammock are cut in a catenary-like configuration and reinforced at said edges, with the reinforced edge at each corner of the hammock attached to the end of a spreader bar placed at each end of the hammock, said bar being bent in a shallow "v" shape, and with the center line of said hammock delineating the two sections being reinforced and attached at each end of said reinforcement to the nadir of said corresponding spreader bar, the difference in elevation of said nadir compared to the ends of the spreader bar being in each case the amount necessary to provide uniform lateral slope on the surface of each section of the hammock upward from any point along a head-foot line, said head-foot line being a line running between the ends of the hammock parallel to the center line and distant therefrom by half the distance along a line running ninety-degrees from the center line, said head-foot line representing the lowest points of sag of the hammock from head to foot, thereby providing a proclivity for the body weight of the occupant of each section to be evenly distributed on each side of said head-foot line, and wherein a stringing assembly is attached at each end of the hammock at the same three points at which the hammock is attached to each spreader bar and running thence to a common point from which common point the hammock is connected to a support at each end, with both of said common points adjustable with respect to the extended center line of the hammock toward whichever section of the hammock may be occupied by a person heavier than the occupant of the other section in order to change the center of gravity to allow the occupancy of said heavier person without tilting the hammock, the dstance of said adjustment of the common point of the stringing assembly away from the extended center line being proportionate to the relative difference in weight of the two occupants, and wherein said head-foot line of each section is made to be either level or given a selected amount of vertical sag normal to the usual beds of the occupants by employing a planned combination of amount of curvature of the catenary-like side edges of the hammock, and the relative length of the spreader bars to the length of the ends of the hammock, the relative elevation of the nadir and ends of the shallow "v"-shaped spreader bar, the initial tautness of the hammock between its supports, and the stretch of materials used in constructing the hammock and stringing assembly when subjected to distance combined weight of the occupants.

14. A hammock for two people as described in claim 13, wherein of the width of a section of the hammock between the catenary-like edge and the center line may be varied at points along the head-foot line according to the curves of the human body, decreasing the width wherever the hammock needs to rise under the body, such as the waist, and increasing the width to lower parts of the hammock for accommodating such parts of the hammock for accommodating such parts as shoulders, rump, and heels.

15. A hammock for two people as in claim 13 wherein, to maintain comfortable space for two occupants of differing weights, the portions of the spreader bars on each side of the nadir thereof are provided with slip-joints or other means for adjusting the length in order to extend the distance between points of attachment of the hammock to the spreader bar along the section of the hammock occupied by the lighter occupant, or to shorten distance between points of attachment of hammock to said spreader bar along the section of the hammock occupied by the heavier occupant, or both, thereby maintaining equivalent slopes on each side of the head-foot line on the surface of the hammock of each of the two sections, and wherein the common point of the stringing assembly is adjustable so that it may be moved toward the side of the heavier occupant in order to maintain lateral balance in the hammock under the differing weights of the occupants.

16. A double hammock as in claim 13 wherein, to maintain comfortable space for two occupants of differing weights, a catenary-like curve is given to the reinforced jointure line marking the two sections of the hammock as distinct bed spaces, with a curve from ends to center moving closer to the head-foot line of the section occupied by the heavier person.

* * * * *

UNITED STATES PATENT AND TRADEMARK OFFICE

CERTIFICATE OF CORRECTION

PATENT NO. : 4,001,902

DATED : January 11, 1977

INVENTOR(S) : John O. Hall; Anna Cobb Hall

It is certified that error appears in the above–identified patent and that said Letters Patent are hereby corrected as shown below:

Column 1, line 20, "connecting" should be --connected--.
Column 2, line 22, "an" should be --and--.
Column 2, line 38, "extented" should be --extended--.
Column 3, line 27, "temperature" should be --temperate--.
Column 3, line 28, "completed" should be --competed--.
Column 3, line 41 "SUMMARY OF THE INVENTION" should be --SUMMARY OF THE INVENTION:--.
Column 4, line 56, "alterntively" should be --alternatively--.
Column 5, line 37, 'FIG." should be --Figs.--.
Column 6, line 25, "32 " should be --32"--.
Column 6, line 40, after "one" insert --side the--.
Column 6, line 59, delete "," after "stringing".
Column 14, line 2, "dstance" should be --distance--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*